US005425660A

United States Patent [19]

Weikle

[11] Patent Number: 5,425,660

[45] Date of Patent: Jun. 20, 1995

[54] COMMUNICATIONS JACK WITH IMPROVED COMB

[75] Inventor: Owen B. Weikle, Hutchinson, Minn.

[73] Assignee: Communications System, Inc., Hector, Minn.

[21] Appl. No.: 171,820

[22] Filed: Dec. 22, 1993

[51] Int. Cl.[6] ..... H01R 13/506

[52] U.S. Cl. ..... 439/676; 439/701; 439/886

[58] Field of Search ..... 439/676, 701, 886

[56] References Cited

U.S. PATENT DOCUMENTS 4,274,691 6/1981 Abernethy et al. ..... 439/701

4,698,025 10/1987 Silbernagel et al. ..... 439/676

4,699,595 10/1987 Nakazawa et al. ..... 439/701

4,703,991 11/1987 Philippson ..... 439/676

*Primary Examiner*—Daniel W. Howell

*Attorney, Agent, or Firm*—Westman, Champlin & Kelly

[57] ABSTRACT

A communications jack includes a spring block having a plurality of conductors. A jack housing has an opening. A comb is separate from the spring block and the jack housing, and is attachable to the spring block. The comb holds ends of the plurality of conductors in spaced relation to one another. The spring block and comb, when attached, are insertable as a unitary piece into the opening in the jack housing.

12 Claims, 2 Drawing Sheets

Fig. 1
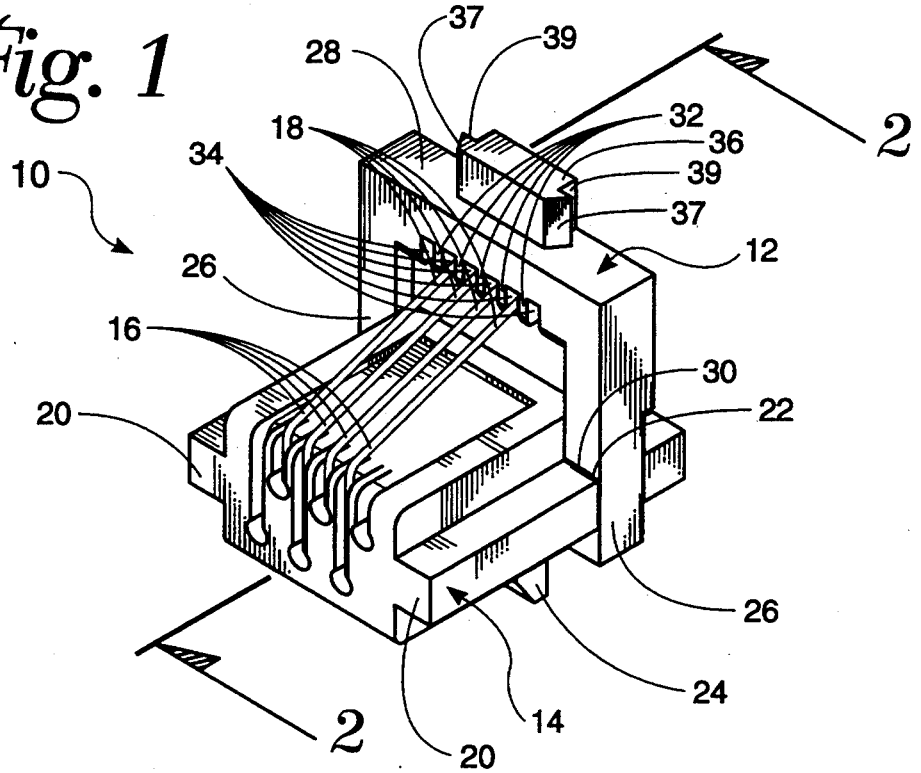
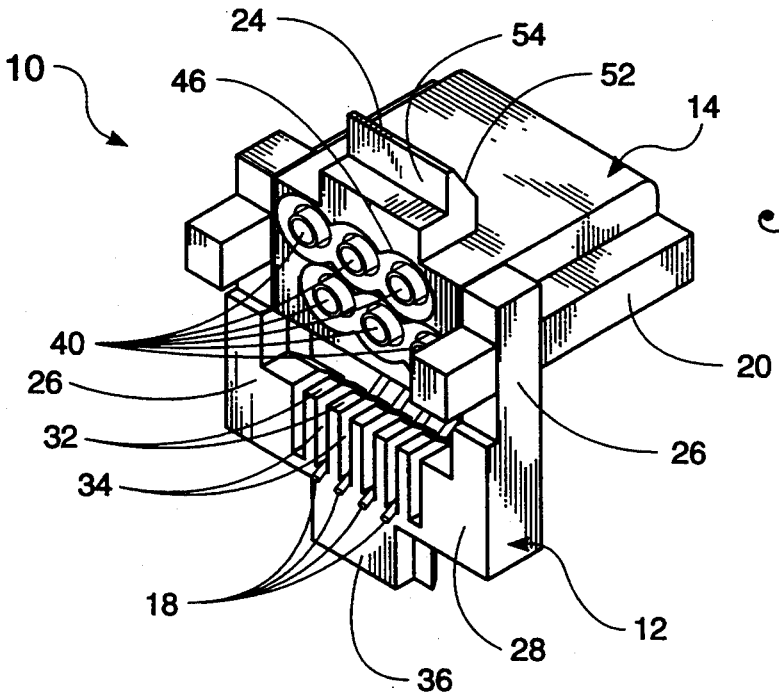
Fig. 3

Fig. 4
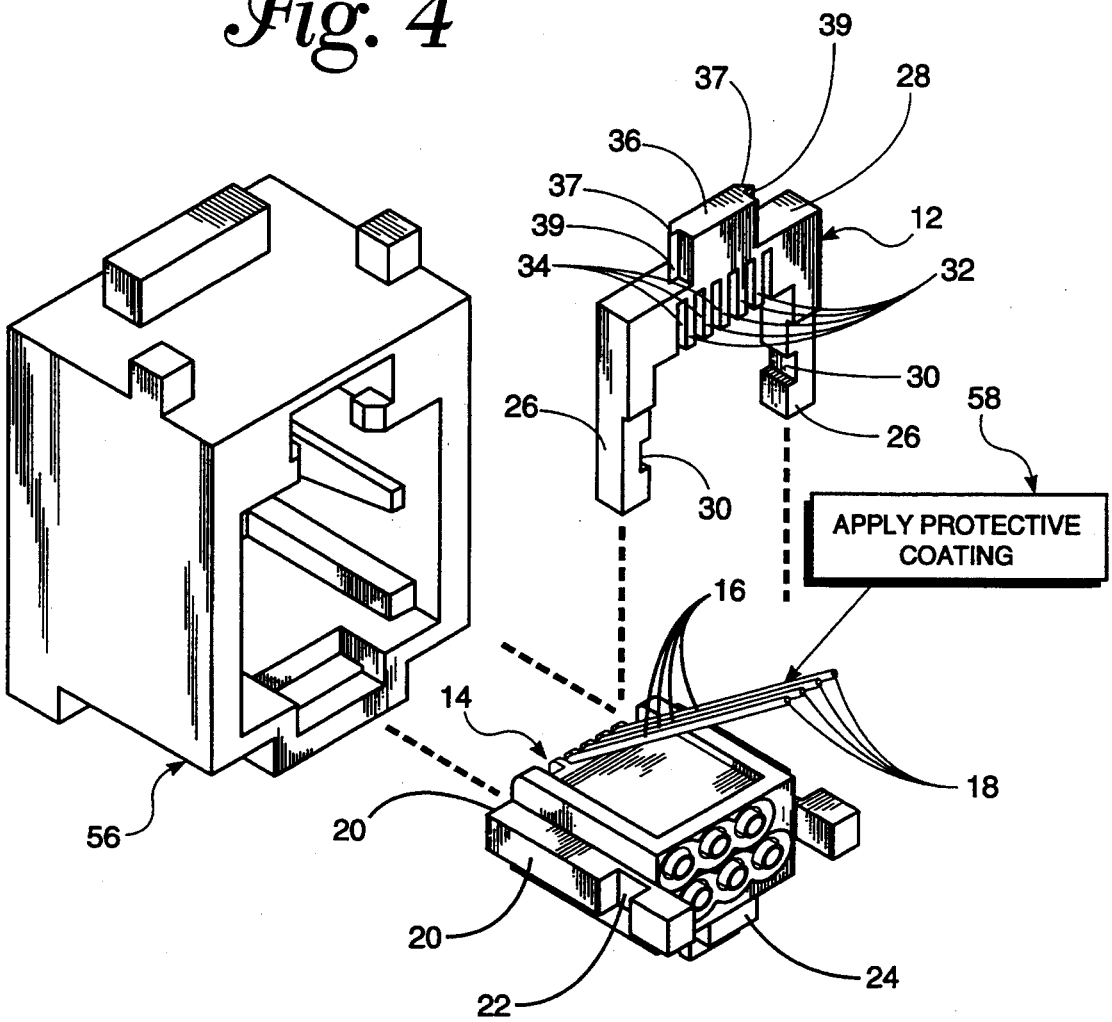
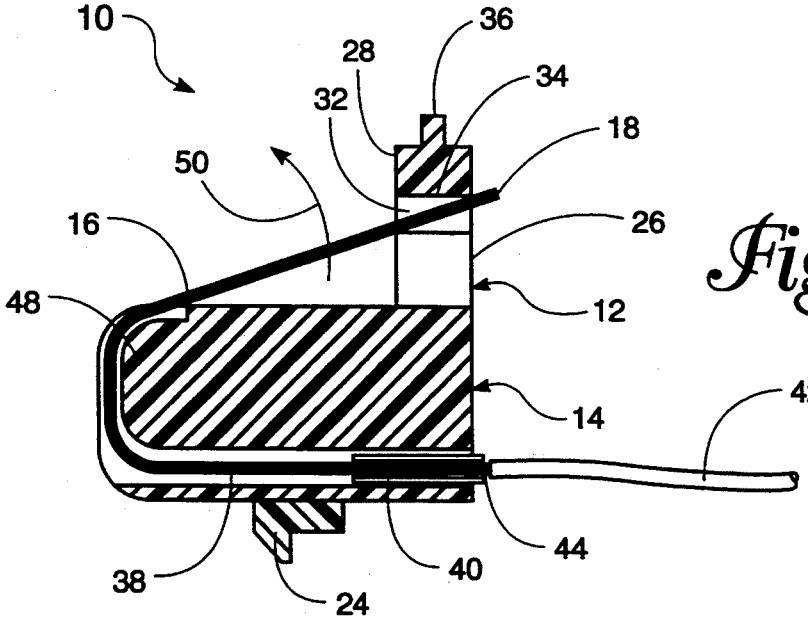
Fig. 2

COMMUNICATIONS JACK WITH IMPROVED COMB

BACKGROUND OF THE INVENTION

The present invention relates to connectors. More specifically, the present invention relates to a communications jack for receiving a connector.

A typical communications jack includes a plurality of spring conductors arranged to make electrical contact with opposing spring conductors supplied by a plug which is inserted into the jack. The spring conductors in the communications jack are secured at their first ends to a spring block. The spring block is conventionally a member which securely holds the first ends of the spring conductors and provides means for connecting the spring conductors to electrical wires which are used to route the signals received on the spring conductors for further processing. The spring conductors are secured to the spring block and bent around the spring block so that the second ends of the spring conductors resiliently extend out away from the spring block.

In conventional jacks, the spring block and the conductors attached to the spring block are inserted into a housing. The housing includes a comb which has typically been molded into the housing and formed integrally with the housing. The comb has a plurality of teeth which define a plurality of gaps. As the spring block is inserted into the housing, the gaps in the comb engage the second ends of the spring conductors to align the spring conductors and hold the second ends of the spring conductors in spaced relation to one another. Once the spring block is fully seated within the jack housing, a tab typically engages a slot within the housing to hold the spring block within the housing.

The housing typically has two openings, one for insertion of the spring block and spring conductors, and the other for insertion of a second connector which carries conductors that are to be electrically connected to the spring conductors. The housing, along with the comb, align the spring conductors so that they are positioned to make electrical contact with opposing conductors carried by the second connector.

The environment in which such jacks are used can be harsh, causing exposed conductors to wear. Therefore, attempts have been made to coat the spring conductors with a protective coating prior to inserting them in the jack housing. In such conventional attempts, the spring conductors are assembled into the spring block. A protective coating is then applied to the conductors on the spring block. However, such a system has only limited effectiveness. As the spring block and spring conductors are inserted into the housing, the exposed surfaces of the spring conductors, which are now coated with a protective coating, engage the comb in the housing. As the spring block is slid or inserted into the housing, substantially the entire exposed surfaces of the spring conductors are scraped by the teeth of the comb. This scrapes much of the protective coating from the exposed surfaces of the spring conductors, leaving them vulnerable to the environment.

SUMMARY OF THE INVENTION

In the present invention, a spring block has a plurality of conductors. A jack housing has an opening. A comb, which is separate from the jack housing, and attachable to the spring block, holds ends of the plurality of spring conductors in spaced relation to one another. The spring block and comb, when attached, are insertable as a unitary piece into the opening in the jack housing.

BRIEF DESCRIPTION OF THE DRAWINGS

FIG. 1 is an elevational view of a comb and spring block of the present invention.

FIG. 2 is a side sectional view of the comb and spring block shown in FIG. 1 taken along section line 2—2.

FIG. 3 is an elevational view of the comb and spring block of FIG. 1 rotated 180°.

FIG. 4 is an exploded view and partial block diagram of the comb and spring block shown in FIGS. 1 and 2, and of a jack housing.

DETAILED DESCRIPTION OF THE PREFERRED EMBODIMENTS

FIG. 1 is an elevational view of a unitary piece 10 of the present invention. Unitary piece 10 includes comb 12, spring block 14 and a plurality of spring conductors 16.

Spring conductors 16 have first ends fixedly connected within spring block 14. Spring conductors 16 also have second ends 18 which extend out and away from spring block 14. Spring block 14 further includes a pair of integrally formed rails 20 which run along opposite sides of spring block 14. Rails 20 have notches 22. Spring block 14 also includes locking tab 24 for securing unitary piece 10 within a housing (shown in FIG. 4).

Comb 12 is formed by a pair of legs 26 which are coupled by a cross member 28. Legs 26 have opposing notches 30 which mate with notches 22 in rails 20 of spring block 14. Cross member 28 includes a plurality of integrally formed teeth 32. Teeth 32 define a plurality of gaps 34 therebetween. Gaps 34 and teeth 32 engage the second ends 18 of spring conductor 16 holding ends 18 in spaced relation to one another. The portion of conductors 16 which extends between spring block 14 and the second ends 18 is exposed for electrical connection to opposing conductors. Cross member 28 further includes locking tab 36 which operates in conjunction with tab 24 to secure unitary piece 10 in the jack housing (shown in FIG. 4).

FIG. 1 shows that locking tab 36 has a pair of angled surfaces 37 and a pair of accompanying retaining surfaces 39. Angled surfaces 37 are used to facilitate insertion of the unitary member 10 into the housing (shown in FIG. 4). Retaining surfaces 39 are utilized to retain unitary member 10 within the housing.

FIG. 2 is a sectional view of unitary piece 10 taken along section line 2—2 shown in FIG. 1. Similar items are similarly numbered. FIG. 2 illustrates the arrangement of spring conductor 16 within block 14. Spring conductor 16 has a first end 38 coupled within an electrical connector 40. Connector 40, in this preferred embodiment, is a crimp connector or other suitable connector. A wire 42 has an exposed end 44 which is also coupled within connector 40. Connector 40 makes electrical contact between end 44 of wire 42 and first end 38 of spring conductor 16. Connector 40 is rigidly connected within a passageway 46 in housing 14. Connector 40, in this preferred embodiment, is press-fit into passageway 46, but can be connected by means of adhesive or any other suitable means. Spring conductor 16 travels through passageway 46 around curved portion 48 of block 14. Because of the resiliency of spring conductor 16, it is biased upwardly in the direction indicated by arrow 50 against gap 34 formed by teeth 32 in comb 12 when comb 12 is in place on spring block 14.

FIG. 3 is an elevational view of unitary piece 10 rotated 180° from that shown in FIG. 1. Similar items are similarly numbered. FIG. 3 shows that spring block 14 includes a plurality of passages 46 which each contain a connector 40. Passages 46 are offset laterally and vertically to accommodate an increased number of passages in a smaller space.

FIG. 3 also shows locking tab 24 in greater detail. Locking tab 24 has an angled surface 52 and a retaining surface 54. Angled surface 52 is used to facilitate insertion of unitary member 10 into the jack housing (shown in FIG. 4). Retaining surface 54 is used to retain unitary member 10 in place within the housing.

FIG. 4 is an exploded view of unitary member 10 and jack housing 56. FIG. 4 illustrates that, during assembly, spring block 14, with attached spring conductors 16, has second ends 18 of spring conductors 16 extending out and away from block 14. Comb 12 is put in place such that notches 30 engage, and seat within, opposing notches 22 on block 14. This can be accomplished in a number of ways. First, since comb 12 is typically formed of a plastic material, it has enough resilience that legs 26 can be moved apart so that notches 30 seat within notches 22. The resilience of the material causes legs 26 to move toward one another thereby holding comb 12 attached to block 14.

Alternatively, notches 30 can be positioned to engage rails 20, and comb 12 can be slid back toward notches 22 along rails 20. Again, the resilience of the legs 26 is enough to cause the legs 26 to snap in place once the notches 30 reach notches 22. While comb 12 is slid rearwardly toward notches 22, teeth 32 separate spring conductors 16 so that the second ends 18 of spring conductors 16 are held by the gaps 34 formed by teeth 32. Second ends 18 are held in spaced relation to one another when comb 12 comes to rest with notches 30 engaging notches 22.

Once comb 12 is attached to spring block 14 to form unitary member 10, a protective coating is applied to conductors 16. This is indicated by block 58. Since comb 12 is already in place on unitary member 10, and is not part of jack housing 56, the unitary member 10 can be inserted into jack housing 56 without removing the protective coating from the exposed portions of spring conductors 16. As the unitary member 10 is inserted into jack housing 56, surfaces 37 and 52 of locking tabs 36 and 24, respectively, engage the surfaces 60 and 62 disposed within, and formed integrally with, jack housing 56. Unitary member 10 is then snapped into place such that retaining surfaces 39 and 54 retain unitary member 10 within jack housing 56 by abutting retaining surfaces 64.

The jack of the present invention provides significant advantages over prior jacks. Comb 12 is neither initially disposed within, nor formed integrally with, jack housing 56. Therefore, comb 12 can be assembled onto spring block 14 prior to insertion of spring block 14 into jack housing 56. With comb 12 assembled onto spring block 14 to form unitary member 10, the protective coating can be applied to the exposed portions of conductors 16. Since comb 12 is already assembled onto spring block 14 prior to application of the protective coating, the coating is not rubbed or scraped off during subsequent assembly steps. Thus, spring conductors 16 are protected from harsh environmental conditions.

Although the present invention has been described with reference to preferred embodiments, workers skilled in the art will recognize that changes may be made in form and detail without departing from the spirit and scope of the invention.

What is claimed is:

1. A communications jack, comprising:

a spring block having a plurality of conductors;

a jack housing having an opening; and a comb, separate from the spring block and jack housing, attachable to the spring block to hold ends of the plurality of conductors in spaced relation to one another, the spring block and the comb, when attached, being insertable as a unitary piece into the opening in the jack housing.

2. The communications jack of claim 1 wherein the jack housing comprises:

attachment means for releasably holding the unitary piece in the jack housing.

3. The communications jack of claim 1 wherein the jack housing comprises:

attachment means for rigidly holding the unitary piece in the jack housing.

4. The communications jack of claim 1 wherein the spring block includes a pair of notches in a perimeter of the spring block, and wherein the comb comprises:

a pair of legs extending from a cross member, each leg having a notch positioned to oppose one of the plurality of notches in the spring block.

5. A method of making a communications jack, comprising:

providing a spring block having a plurality of electrical conductors extending from the spring block;

attaching a comb to the spring block to hold ends of the electrical conductors extending from the spring block in spaced relation to one another;

applying a protective coating to the electrical conductors; and wherein providing a spring block and attaching a comb are performed before applying a protective coating.

6. The method of claim 5 and further comprising:

inserting the spring block and comb, as a unitary piece, into a jack housing after applying the protective coating to the electrical conductors.

7. The method of claim 5 wherein attaching the comb comprises:

releasably attaching the comb to the spring block.

8. The method of claim 5 wherein attaching the comb comprises:

rigidly attaching the comb to the spring block.

9. The method of claim 5 wherein the electrical conductors have first ends connected to the spring block, and further comprising:

electrically connecting the first ends of the electrical conductors to wires.

10. A communications jack, comprising:

a plurality of spring conductors each having a first end and a second end;

a block, coupled to the first ends of the spring conductors, having connectors for electrically connecting the first ends of the spring conductors to electrical conductors;

a comb coupled to the block and having a plurality of teeth defining a plurality of gaps which hold the second ends of the spring conductors spaced apart from one another, the comb and block, when coupled together, forming a unitary piece; and a housing having an aperture for receiving the unitary piece and an aperture for receiving a second connector, the housing aligning the spring conductors to meet opposing conductors on the second connector.

11. The communications jack of claim 10 wherein the comb comprises:

a pair of legs each having an opposing notch; and a cross member, coupled between the pair of legs, the cross member having the plurality of teeth formed integrally with the cross member to define the plurality of gaps.

12. The communications jack of claim 11 wherein the block includes a plurality of notches in a perimeter of the block, the plurality of notches in the perimeter of the block being aligned to mate with the opposing notches in the pair of legs.

* * * * *

UNITED STATES PATENT AND TRADEMARK OFFICE

CERTIFICATE OF CORRECTION

PATENT NO. : 5,425,660

DATED : June 20, 1995

INVENTOR(S) : Owen B. Weikle

It is certified that error appears in the above-indentified patent and that said Letters Patent is hereby corrected as shown below:

Title page, item: [73]: Change the name of the Assignee from "Communications System, Inc." to --Communications Systems, Inc.--.

Signed and Sealed this

Twenty-sixth Day of December, 1995

*Attest:*

Bruce Lehman

BRUCE LEHMAN

*Attesting Officer*

*Commissioner of Patents and Trademarks*